US008020403B2

(12) United States Patent
Rotter et al.

(10) Patent No.: US 8,020,403 B2
(45) Date of Patent: Sep. 20, 2011

(54) REFRIGERATOR WITH CEILING MOUNTED WATER SYSTEM

(75) Inventors: Chad J. Rotter, Amana, IA (US); David A. Stauffer, Belle Plaine, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 342 days.

(21) Appl. No.: 12/277,902

(22) Filed: Nov. 25, 2008

(65) Prior Publication Data

US 2010/0126210 A1 May 27, 2010

(51) Int. Cl.
*F25D 23/12* (2006.01)
*F25D 3/00* (2006.01)
*F25D 11/00* (2006.01)

(52) U.S. Cl. ..... 62/389; 62/338; 62/443

(58) Field of Classification Search ..... 62/337–339, 62/440–466, 264; 312/401–408
See application file for complete search history.

(56) References Cited

U.S. PATENT DOCUMENTS

| | | | | | |
|---|---|---|---|---|---|
| 1,916,032 | A | | 6/1933 | Allyne | |
| 2,031,283 | A | * | 2/1936 | Scofield | 222/183 |
| 2,720,089 | A | | 10/1955 | Morton | |
| 2,914,218 | A | | 11/1959 | Korodi | |
| 3,572,049 | A | * | 3/1971 | Moorman | 62/132 |
| 4,191,434 | A | | 3/1980 | Powell et al. | |
| 4,223,538 | A | | 9/1980 | Braden et al. | |
| 4,288,992 | A | * | 9/1981 | Eliason | 62/256 |
| 4,387,578 | A | | 6/1983 | Paddock | |
| 4,490,986 | A | | 1/1985 | Paddock | |
| 4,944,157 | A | | 7/1990 | Jenkins et al. | |
| 4,970,871 | A | * | 11/1990 | Rudick | 62/187 |
| 5,083,442 | A | | 1/1992 | Vlock | |
| 5,135,645 | A | * | 8/1992 | Sklenak et al. | 210/97 |
| 5,349,832 | A | | 9/1994 | Johnson et al. | |
| 5,397,462 | A | | 3/1995 | Higashijima et al. | |
| 5,558,419 | A | | 9/1996 | Dasher et al. | |
| 5,701,235 | A | | 12/1997 | Hagemeyer Cook et al. | |
| 5,715,699 | A | | 2/1998 | Coates et al. | |
| 5,819,547 | A | * | 10/1998 | Oh | 62/188 |
| 5,907,958 | A | | 6/1999 | Coates et al. | |
| 5,956,967 | A | | 9/1999 | Kim | |
| 6,036,294 | A | | 3/2000 | Banicevic et al. | |
| 6,079,221 | A | * | 6/2000 | Senner | 62/338 |
| 6,085,542 | A | | 7/2000 | Johnson et al. | |
| 6,120,685 | A | | 9/2000 | Carlson et al. | |
| 6,199,400 | B1 | | 3/2001 | Banicevic et al. | |
| 6,303,031 | B1 | | 10/2001 | Senner | |
| 6,337,015 | B1 | | 1/2002 | Poirier | |

(Continued)

*Primary Examiner* — Frantz F Jules
*Assistant Examiner* — Cassey Bauer
(74) *Attorney, Agent, or Firm* — John W. Morrison; McKee Vorhees & Sease PLC

(57) ABSTRACT

An improved bottom mount refrigerator is provided with water and lighting systems housed in a space adjacent the top of the fresh food compartment between a false ceiling and the top wall of the liner. The water system includes a filter manifold, filter cartridge, storage tank, and valve mounted to a bracket. The lighting system, including the fixtures and wiring harness, are also mounted in the bracket. The water and lighting systems are pre-assembled on the bracket, which is then secured to the liner. The false ceiling includes a tank cover, a pivotal filter cover, and a removable light cover. The false drop ceiling hides the water and light systems and the mounting bracket. A front façade closes the gap between the ceiling and the liner. The ceiling and façade provide an aesthetically pleasing appearance for the upper portion of the fresh food compartment of the refrigerator.

20 Claims, 17 Drawing Sheets

U.S. PATENT DOCUMENTS

| | | | | |
|---|---|---|---|---|
| 6,698,222 | B2 | 3/2004 | Sanna et al. | |
| 6,735,976 | B2 | 5/2004 | Lee | |
| 6,779,357 | B1 | 8/2004 | Fann | |
| 6,880,949 | B2 | 4/2005 | Miozza et al. | |
| 6,912,867 | B2 * | 7/2005 | Busick | 62/338 |
| 7,000,407 | B2 | 2/2006 | Miozza et al. | |
| 7,056,435 | B2 | 6/2006 | Jenkins et al. | |
| 7,083,725 | B2 | 8/2006 | Jenkins, Jr. et al. | |
| 7,185,507 | B2 | 3/2007 | Maglinger et al. | |
| 7,228,702 | B2 | 6/2007 | Maglinger et al. | |
| 7,266,972 | B2 | 9/2007 | Anselmino et al. | |
| 7,337,620 | B2 | 3/2008 | Coulter et al. | |
| 7,343,757 | B2 | 3/2008 | Egan et al. | |
| 7,392,665 | B2 | 7/2008 | Lee et al. | |
| 2008/0130203 | A1 | 6/2008 | Doberstein et al. | |

* cited by examiner

REFRIGERATOR WITH CEILING MOUNTED WATER SYSTEM

BACKGROUND OF THE INVENTION

Many household refrigerators have a fresh food compartment above a freezer compartment, commonly known as a bottom mount refrigerator. Bottom mount refrigerators normally do not have an ice dispenser in the doors for the fresh food compartment, since ice is normally made in the freezer compartment and would have to be transported upwardly for dispensing. Recently, bottom mount refrigerators have become available with an ice maker in the fresh food compartment and an ice dispenser in the door. Some of these newer bottom mount refrigerators also include a water dispenser in the door of the fresh food compartment. However, the water tank and filter for these newer refrigerators are mounted in the side or rear wall of the fresh food compartment, which takes up valuable food space, and creates a displeasing aesthetic appearance. Furthermore, during installation of the water system, the tank and filter manifold are normally installed as separate components within the fresh food compartment, which has limited space for making the plumbing connections. The confined space results in increased assembly and installation time.

Therefore, a primary objective of the present invention is the provision of an improved bottom mount refrigerator having a water system mounted in the ceiling so as to maximize the space in the fresh food compartment.

Another objective of the present invention is the provision of a bottom mount refrigerator having a drop ceiling for hiding a water tank and filter mounted above the ceiling.

Another objective of the present invention is the provision of a bottom mount refrigerator having a bracket subassembly supporting a water tank, filter, valve, and light source for pre-assembly before installation of the bracket in the refrigerator compartment.

Still another objective of the present invention is the provision of a water storage tank in the ceiling of a refrigerator oriented horizontally, with an outlet which minimizes the air in the tank.

Yet another objective of the present invention is the provision of an improved bottom mount refrigerator having a water system which can be quickly and easily installed in the top of the fresh food compartment and hidden by an aesthetically pleasing false ceiling.

These and other objectives will become apparent from the following description of the invention.

BRIEF SUMMARY OF THE INVENTION

The present invention is directed to a bottom mount refrigerator having a water system and lighting system pre-assembled on a mounting bracket for installation in the top of the refrigerator fresh food compartment. A false drop ceiling covers the water system, lighting system, and mounting bracket to provide an aesthetically pleasing appearance inside the fresh food compartment. The ceiling includes a pivotal filter cover moveable between open and closed positions to provide access to the water filter, a tank cover for hiding the water storage tank, and a removable light cover to provide access to the light source. The false drop ceiling defines a space for housing the bracket, water system components, and light system between the liner and the ceiling. A façade extends across the front to cover and hide the space and provide improved aesthetics. The water filter manifold, filter cartridge, water storage tank, valve, thermostat, light fixture, and wiring harness are pre-assembled on the mounting bracket, which can then be installed in the roof of the fresh food compartment. Then, the false ceiling can be installed, followed by the covering façade.

DETAILED DESCRIPTION OF THE PREFERRED EMBODIMENT

Figure 1:
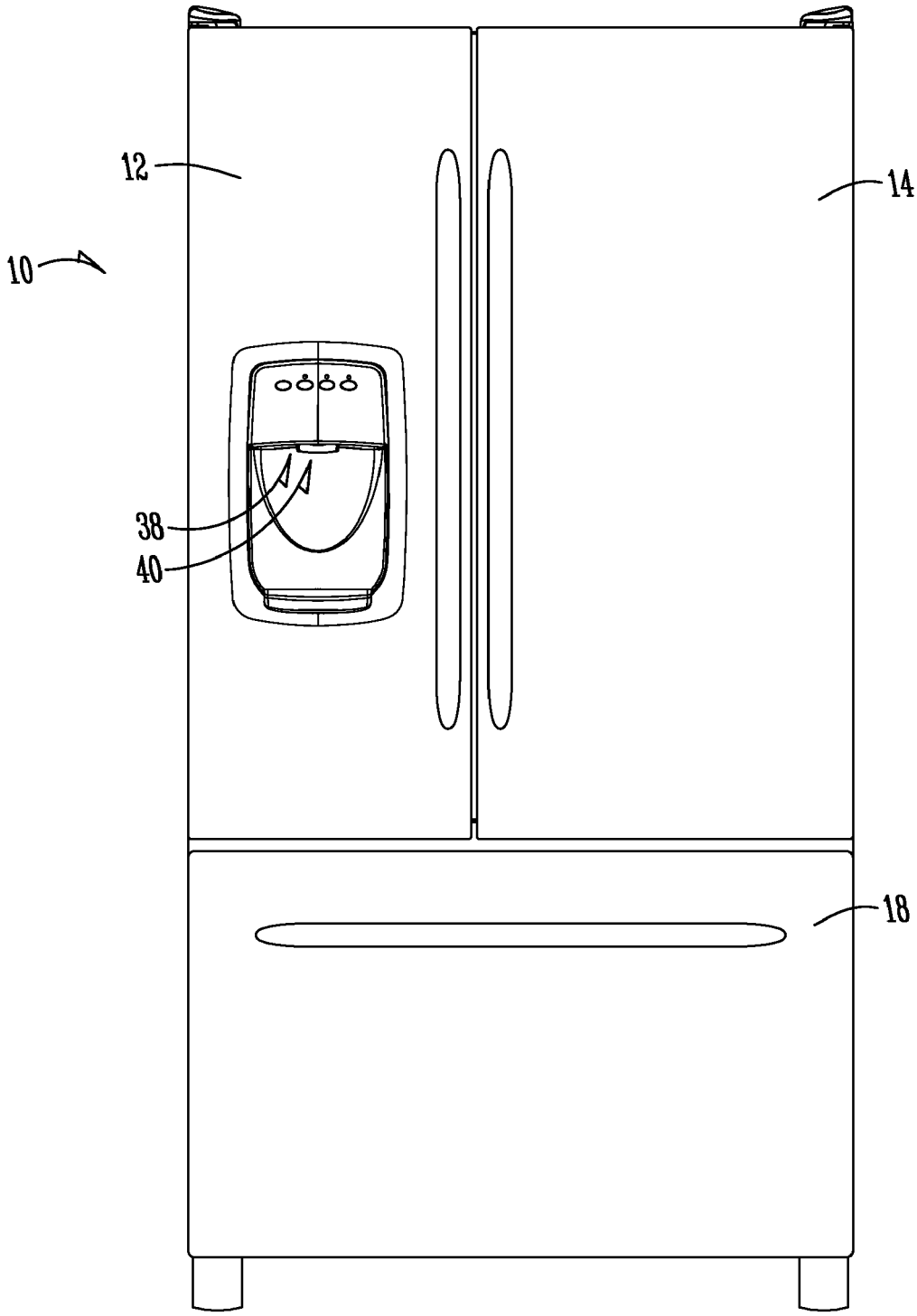
FIG. 1 is a front elevation view of a bottom mount refrigerator.
Figure 2:
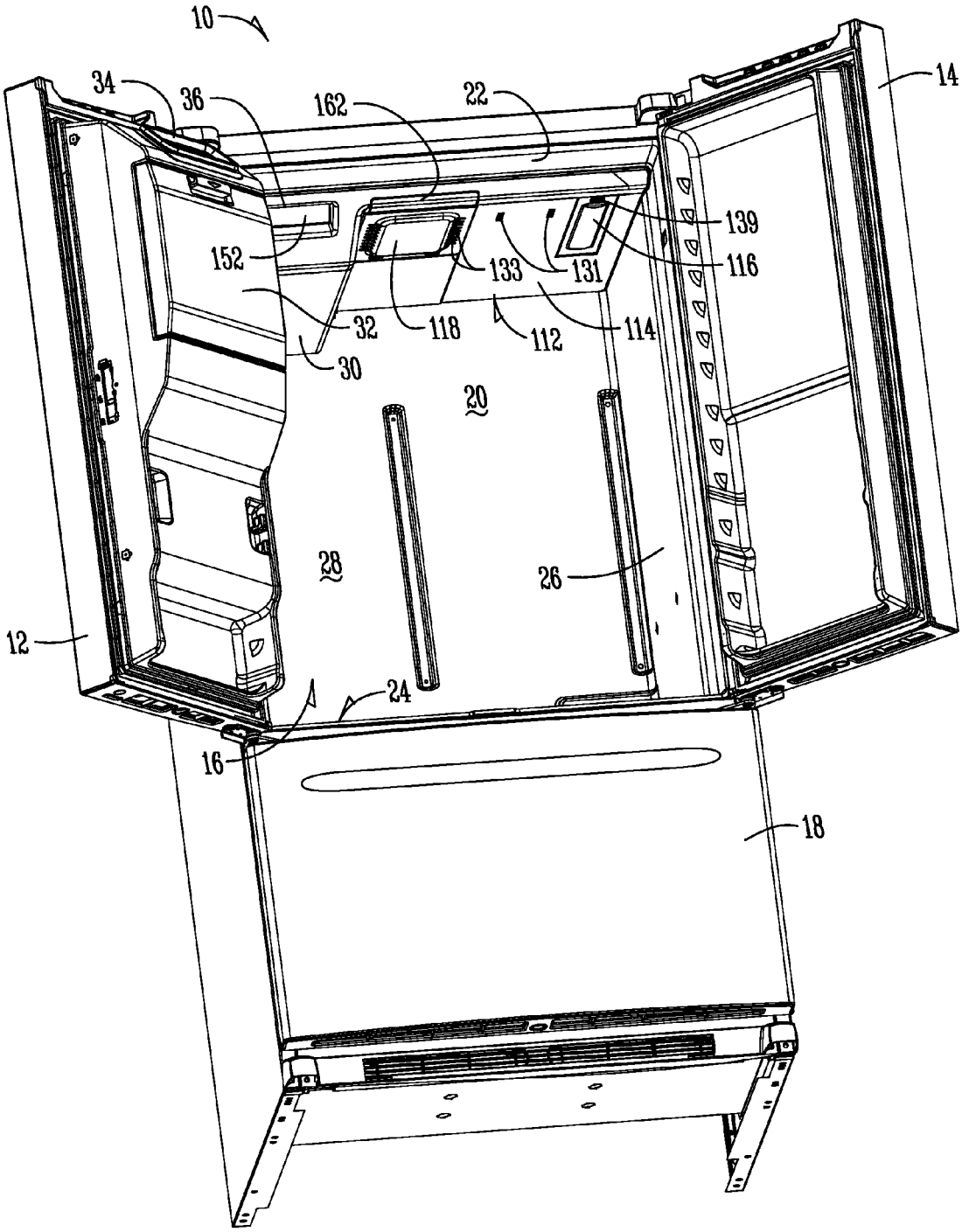
FIGS. 2 and 3 are perspective views of a bottom mount refrigerator having the fresh food compartment doors opened to show the false ceiling and façade which hide the water and lighting systems mounted in the top of the fresh food compartment according to the present invention.
Figure 3:
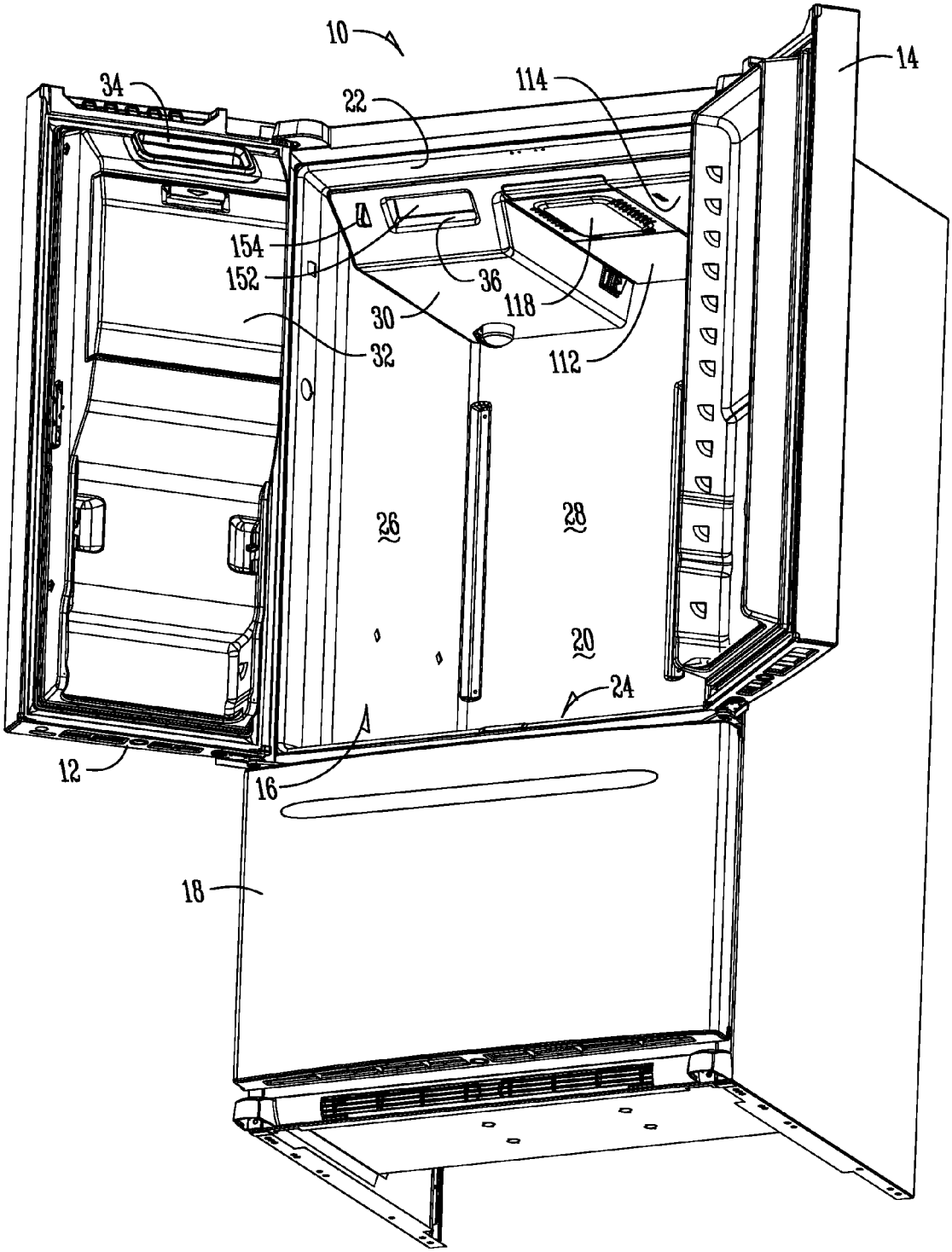

A bottom mount refrigerator 10 is shown in FIGS. 1-3. The refrigerator 10 includes a pair of French doors 12, 14, which open and close relative to the fresh food compartment 16. A freezer door 18 attached to a slide-out drawer (not shown) covers the freezer compartment at the bottom of the refrigerator 10.

An insulated liner 20 is provided in the fresh food compartment 16, and includes a top wall 22, a bottom wall 24, opposite side walls 26, and a rear wall 28. Shelving (not shown) is installed to the liner 20 in well-known manners to support food and beverage items.

An ice making compartment 30 is provided at the top of the fresh food compartment 16 adjacent the top wall 22 of the liner 20. The door 12 includes an interior ice storage compartment 32 which is in communication with the ice making compartment 30 via aligned openings 34, 36 in the ice storage and ice making compartments 30, 32, respectively, when the door 12 is closed. An ice dispenser 38 is provided on the outside of the door 12. The door 12 also includes a water dispenser 40, which dispenses water in a conventional manner.

Figure 7:
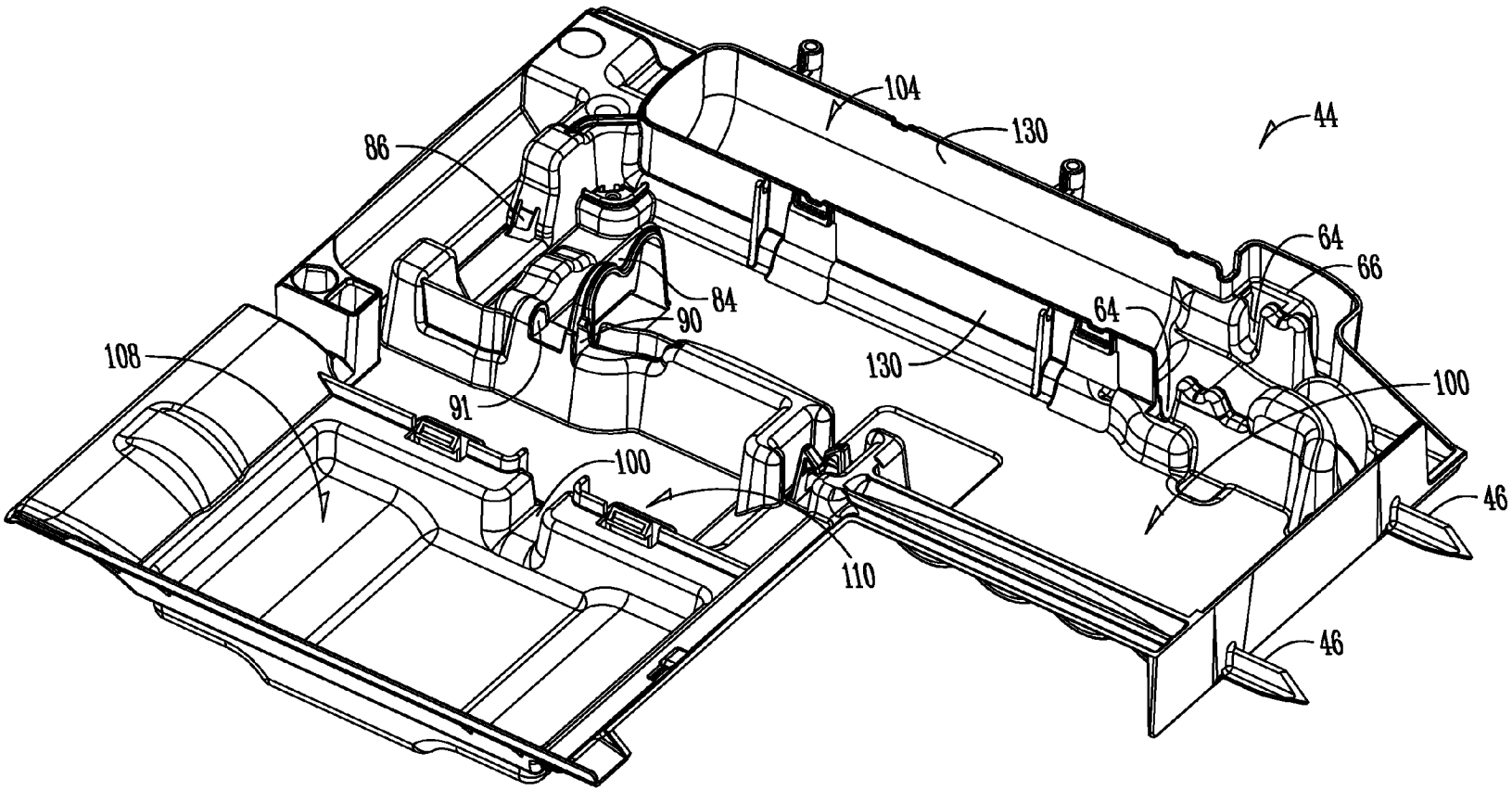
FIG. 7 is a perspective view of the mounting bracket of the present invention without any components mounted therein.

The present invention is directed towards the water and lighting systems of the refrigerator 10, both of which are mounted at the top of the fresh food compartment 16 so as to maximize useable space in the compartment 16. More particularly, the top wall 22 of the liner 20 includes a recess for receiving a bracket or panel 44, which supports the water and lighting systems for the refrigerator 10. The bracket is best seen in FIG. 7. The bracket 44 includes a pair of pins 46 which are received through openings in the liner 20 and extend into the foam behind the liner. The bracket 44 is supported on one side by a tongue and groove connection to the outside wall of the compartment 30. A pair of clips are provided on the front edge of the bracket for fastening through corresponding slots in the top wall 22 of the liner 20. In the preferred embodiment, the right side of the bracket is unsupported, though a supporting connection to the liner 20 can be provided in an alternative embodiment.

Figure 8:
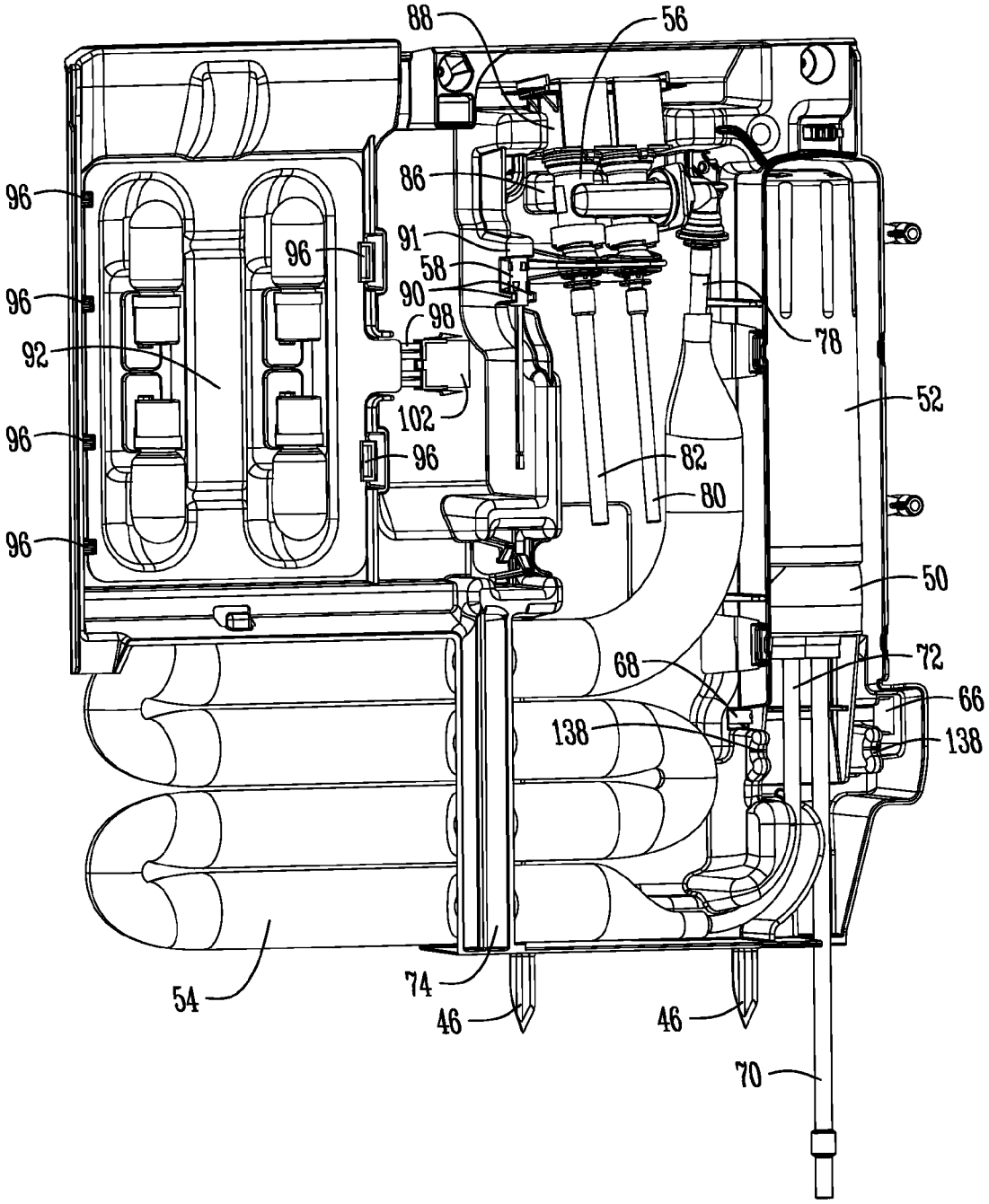
FIG. 8 is a plan view of the mounting bracket with the water and lighting systems mounted therein.

The water system for the refrigerator 10 is mounted to the bottom or lower surface of the bracket 44, as best seen in FIG. 8. The water system includes a filter manifold 50, a filter cartridge 52, a water tank 54, a dual-function valve 56, and a thermostat 58.

The filter manifold 50 includes a body 60, with a pair of pins 62 extending from opposite sides so as to define a pivot axis. The pins are received in recesses 64 in the bracket 44 and are retained in any convenient manner. For example, in a preferred embodiment, one of the pins extends into a hole in the wall 66, while the opposite pin is snap fit beneath a tab 68 so that the manifold 50 is pivotally mounted to the bracket 44. The filter cartridge 52 is mounted to the manifold 50 by threads or twist block action, as is known in the art. A water inlet line 70 supplies water from a water source (not shown) to the manifold 50 and the cartridge 52. A water outlet line 72 delivers filtered water from the filter manifold 50 to the water tank 54.

The water tank 54 is preferably tubular, extending in a serpentine path, as seen in FIG. 8. The tank 54 is retained in the bracket 44 by a strap 74. The tank 74 slides beneath the strap 74 into position on the bracket 44. The tank 54 resides in a substantially horizontal orientation. The outlet line 78 is preferably connected at the highest elevation of the tank 54 near the top wall thereof, so as to minimize air within the tank 54. When the tank 54 is initially filled with water, air accumulating in the upper region of the tank is forced or carried out of the tank as water passes through the outlet line 78.

Figure 12:
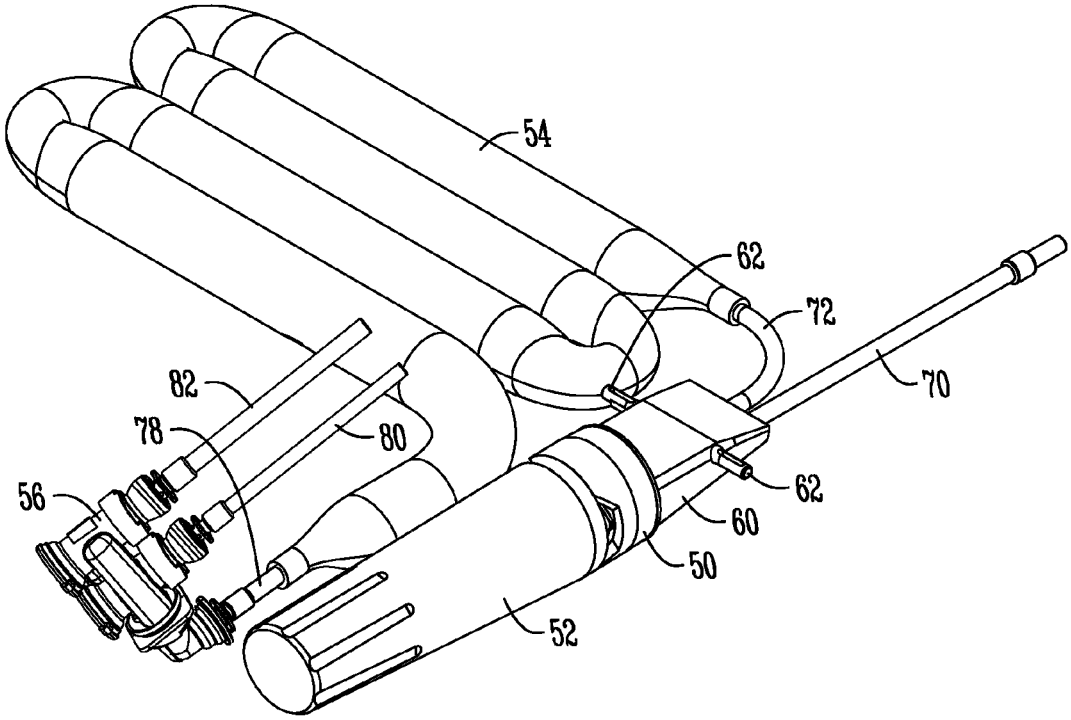
FIG. 12 is a plan view showing the water system of the present invention.
Figure 13:
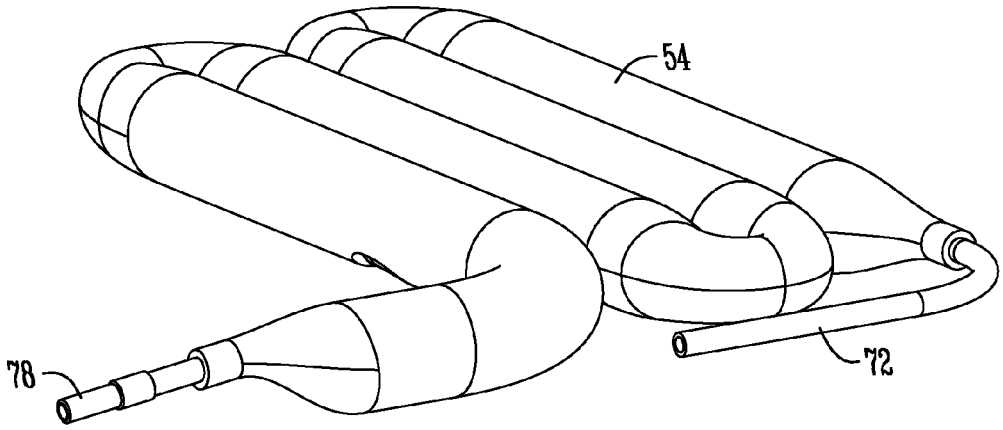
FIG. 13 is a perspective view of the water storage tank of the present invention.
Figure 14:
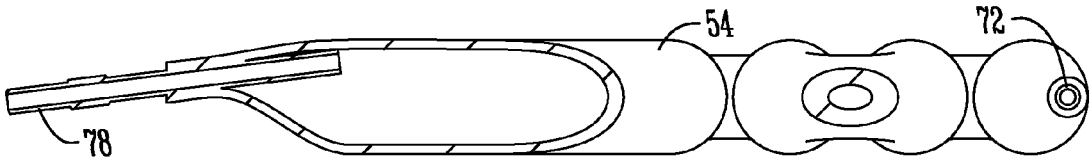
FIG. 14 is a sectional view of the outlet end of the water tank.

The outlet line 78 is connected to the inlet of the valve 56, as best seen in FIGS. 8 and 12. The valve 56 includes a pair of outlet ports with lines 80, 82 delivering water to the ice maker in the ice compartment 30 and to the water dispenser 40, respectively. The valve 56 is fixed in the bracket 44 by a stirrup or strap 84 extending over the outlet ports of the valve and by tabs 86 snapped over the base or housing 88 of the valve 56. Preferably, the valve 56 includes a pair of solenoids to control flow of water out the lines 80, 82, as is known in the art.

The thermostat 58 is mounted to the bracket 54 via a snap fit of the thermostat body between a pair of upstanding legs 90, as seen in FIG. 8. The head of the thermostat 58 may be received within a socket formed in a projection 91 of the bracket 44. The thermostat 58 is connected to the electrical system of the refrigerator 10 in any convenient manner.

The bracket 44 also supports the light assembly or fixture 92 for the fresh food compartment 16 of the refrigerator 10. The lighting system 92 includes one or more fixtures, such as incandescent bulbs or LEDs 94. The lighting system 92 is retained on the bracket 44 by tabs 96 which overlap the perimeter edge of the lighting fixture. A wiring harness 98 for the lighting system extends through a channel 100 in the bracket 44 and includes a plug 102 for quick and easy connection to the electrical system of the refrigerator 10.

As seen in FIG. 7, the bracket 44 includes a plurality of walls which define recesses 104, 106, 108 and 110 to receive the filter cartridge 52, water tank 54, lighting fixture 92, and wiring harness 98. The walls of the recesses 104 and 106 also prevent water from passing into the recesses 108, 110 in the event of a water leak in any of the water components or lines. Thus, the bracket 44 also provides a safety feature for the water and lighting systems of the refrigerator 10.

The present invention also includes a false ceiling 112 for covering the mounting bracket 44 and the components mounted therein. The ceiling 112 includes a tank cover 114, a pivotal filter cover 116, and a light cover 118. The tank cover 114 supports the filter cover 116 and the light cover 118. The light cover 118 is transparent or translucent to permit illumination of the fresh food compartment 16 by the lighting fixture 92 when one or both of the doors 12, 14 are open.

Figure 5:
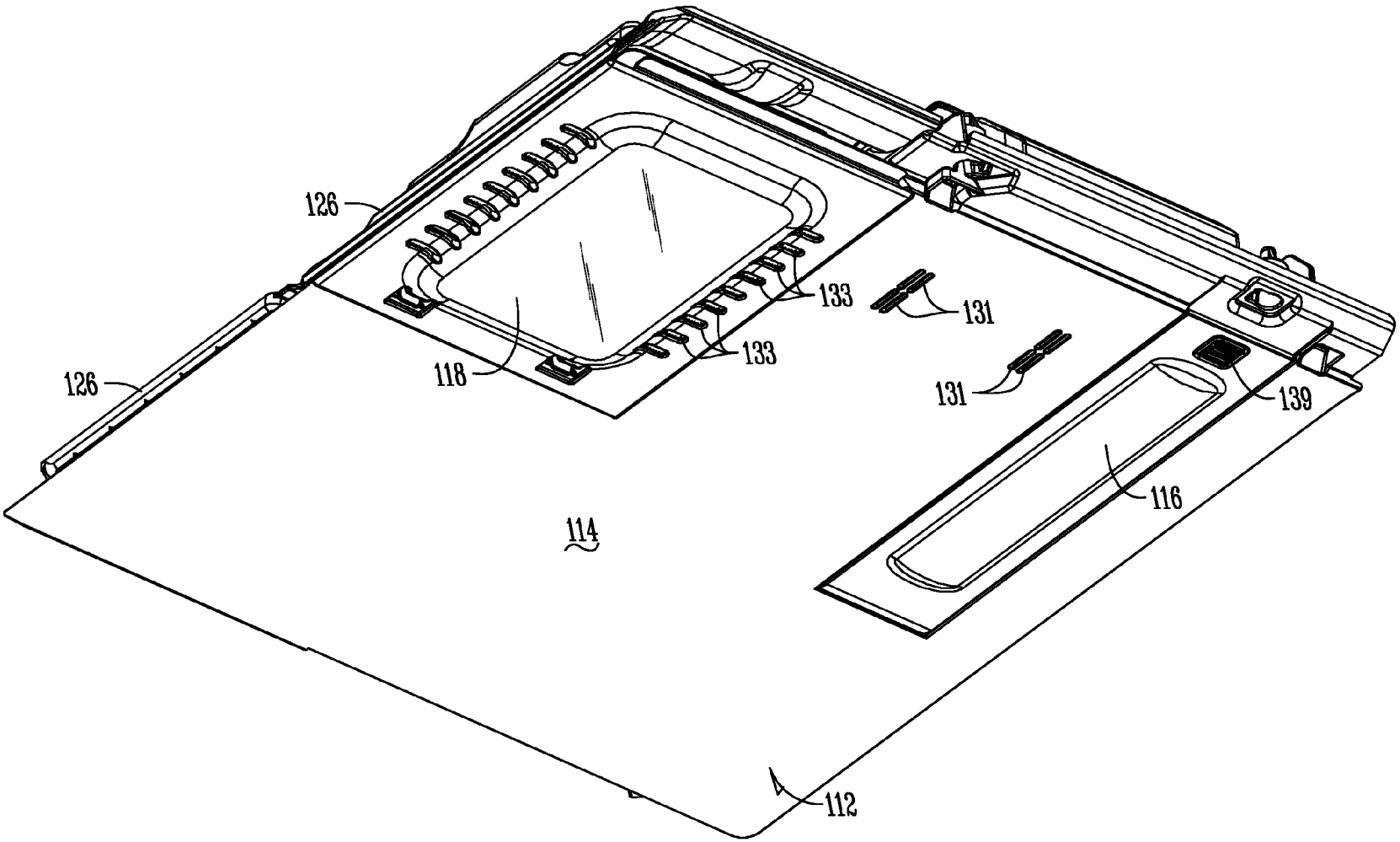
FIG. 5 is a perspective view of the lower surface of the false ceiling of the present invention.
Figure 6:
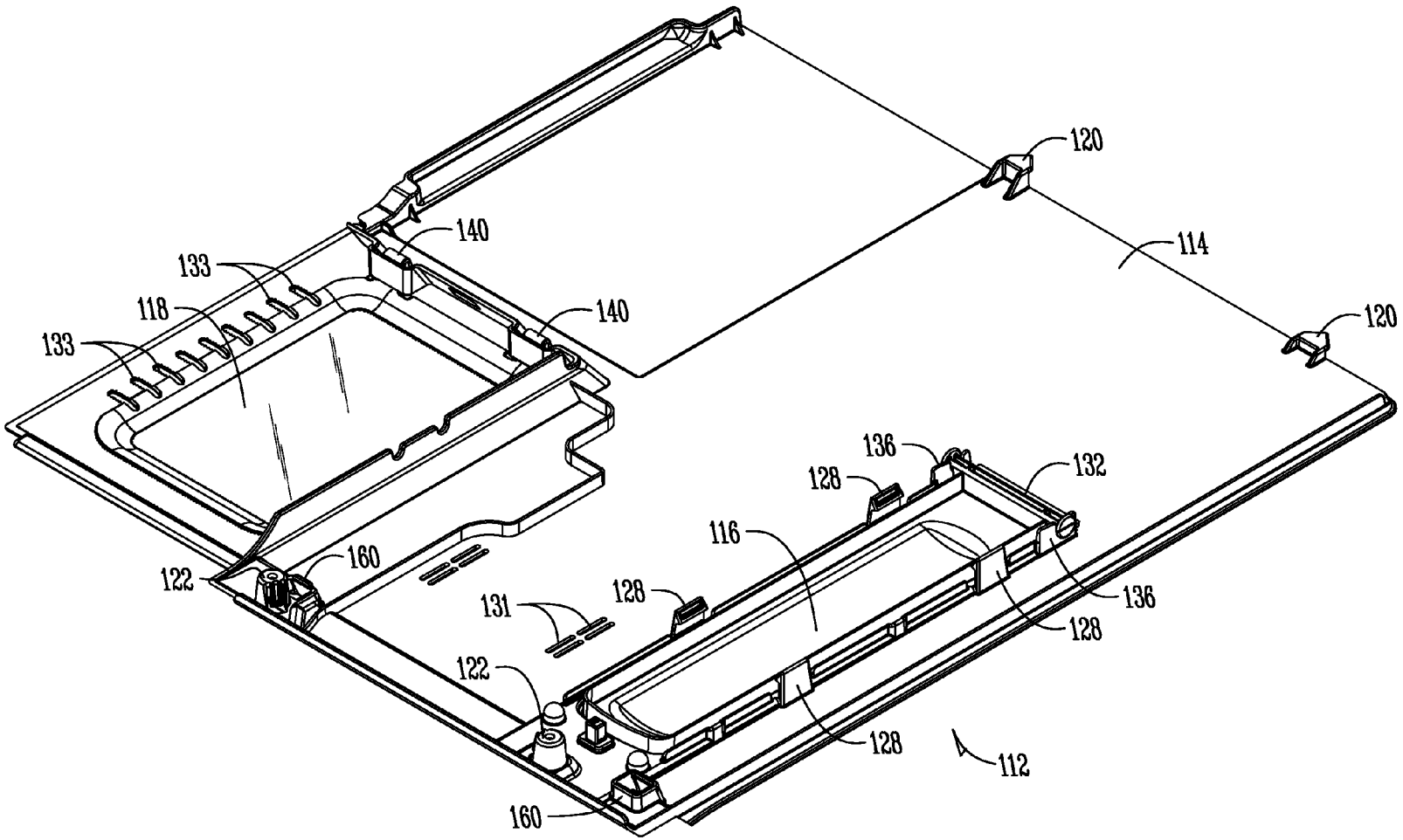
FIG. 6 is a perspective view of the upper surface of the false ceiling of the present invention.

The tank cover 114 includes a pair of tabs 120 on the rearward edge which are received in corresponding openings in the back wall 28 of the liner 20. The front edge of the tank cover 114 has a pair of bosses 122 (FIG. 6) through which screws extend to support the tank cover 114 on the bracket 44. Alternatively, snap tabs can be used, rather than screws. As seen in FIG. 5, the left edge of the tank cover 114 includes a lip or tongue 126 which is received on top of a flange or in a groove or slot formed in the right sidewall of the ice compartment to further support the tank cover 114. As seen in FIG. 6, the right side of the tank cover 114 includes a plurality of tabs 128 which extend upwardly through slots in the bracket 44 to snap fit to the opposite walls 130 which define the filter recess 104. Thus, the tank cover 114 is supported on four sides. The tank cover 114 includes holes 131 for water drainage in the even of a leak in the water system.

Figure 4:
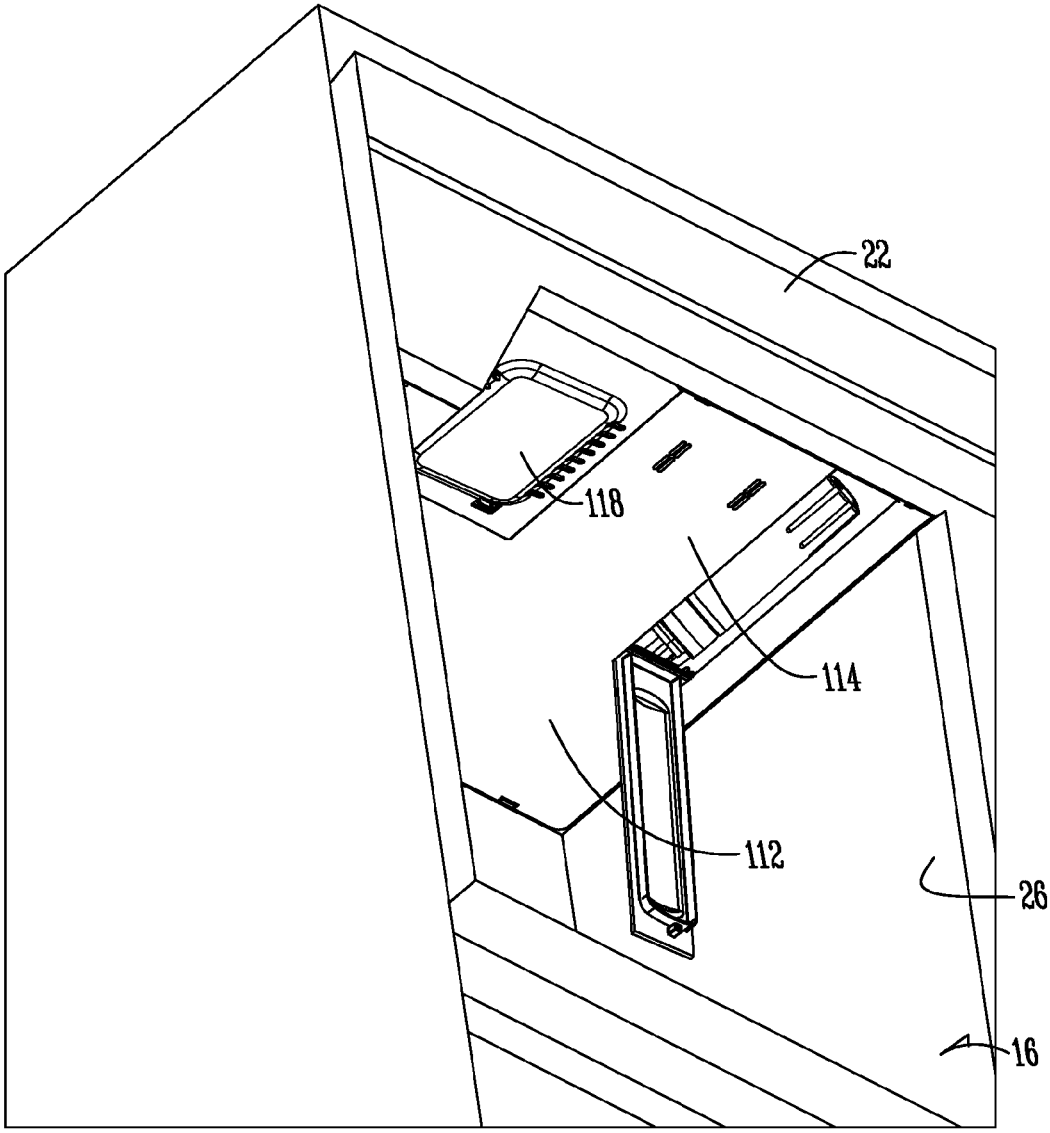
FIG. 4 is a view similar to FIG. 2 showing the filter cover opened for access to the water filter cartridge.
Figure 9:
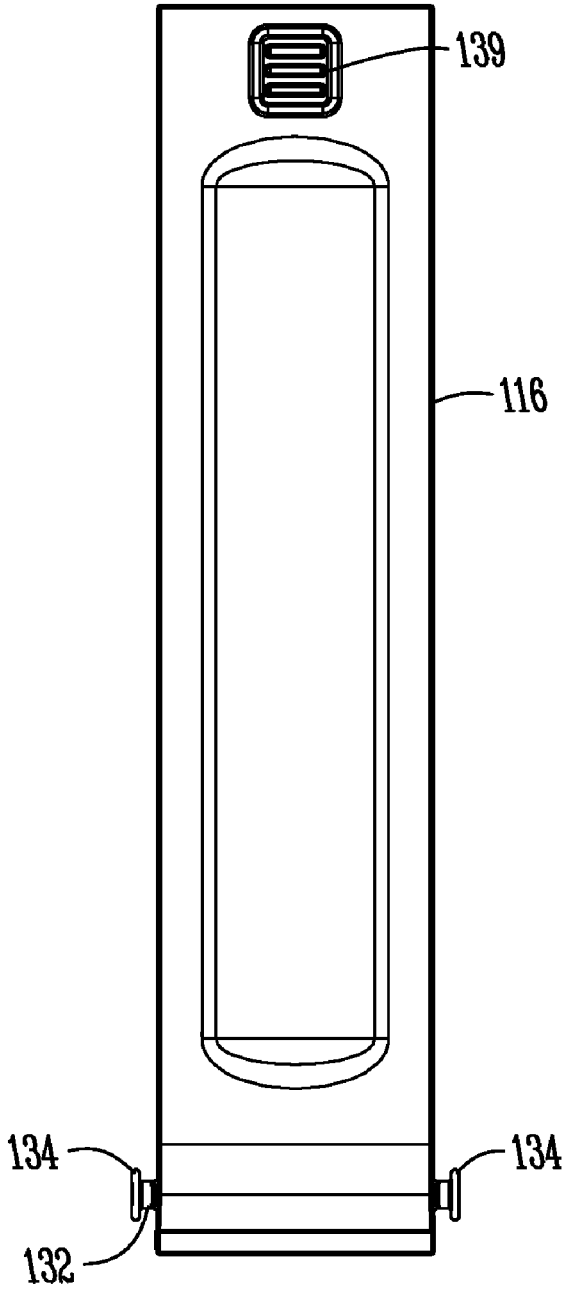
FIG. 9 is a plan view of the filter cover of the false ceiling.
Figure 10:
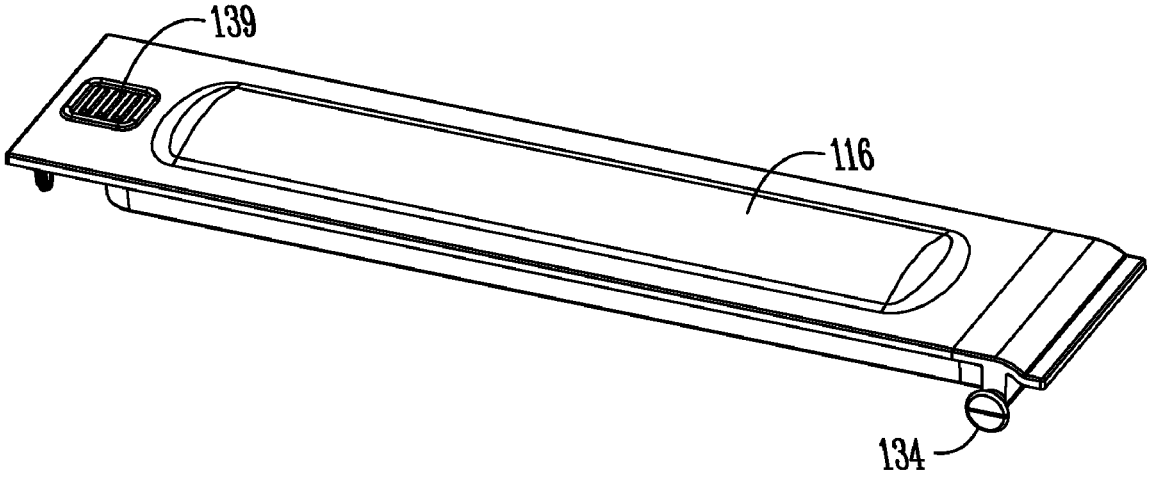
FIG. 10 is a perspective view of the filter cover.
Figure 11:
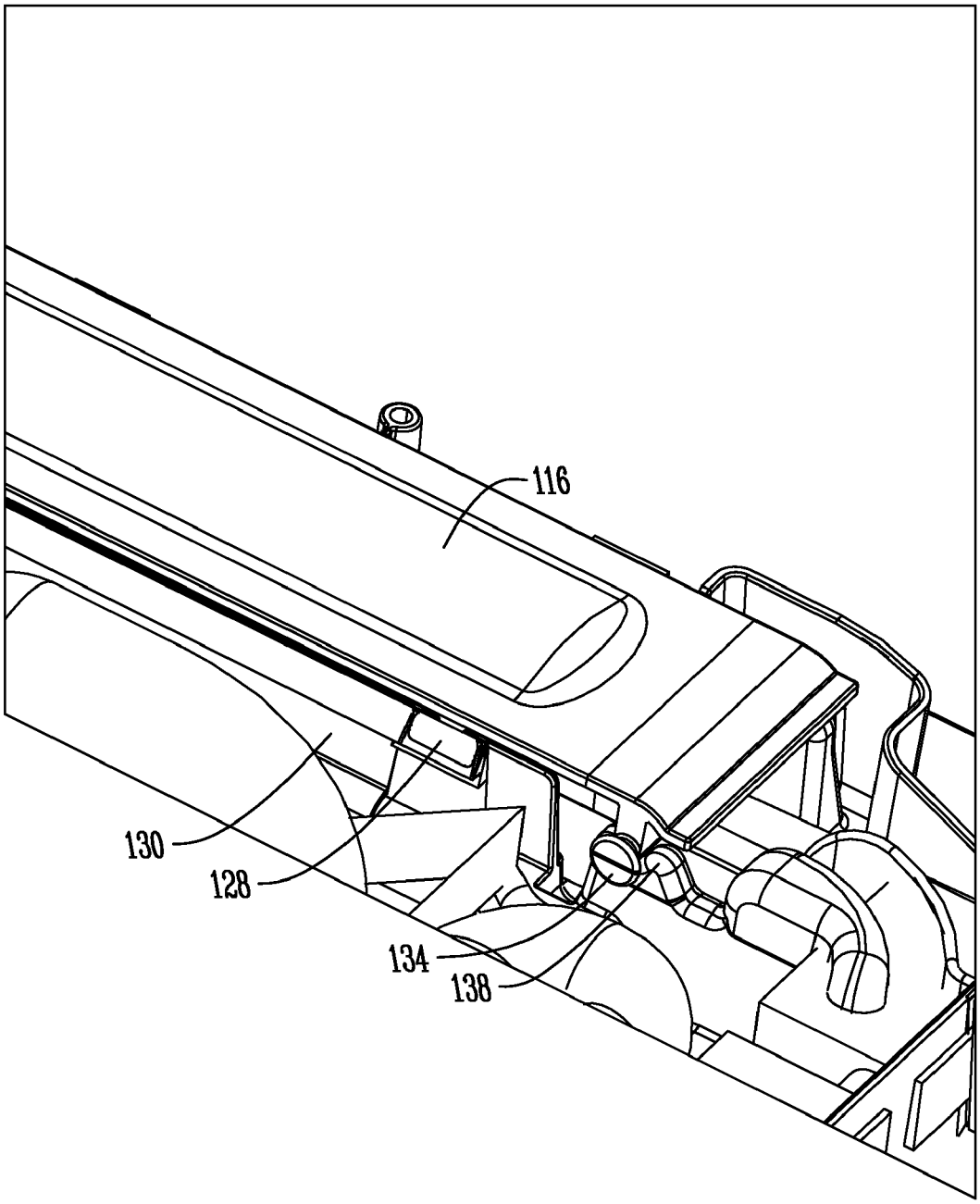
FIG. 11 is an enlarged view showing the filter cover in position relative to the mounting bracket.

The filter cover 116 is pivotally mounted at its rearward end to the tank cover 114. As seen in FIGS. 6, 9 and 10, the filter cover 116 includes an axle 132 terminating in enlarged heads 134, with the axle being journaled in opposite supports 136 on the tank cover 114. The axle 132 is also received in cradles 138 formed in the bracket 44, as seen in FIG. 11. The front end of the filter cover 116 is releasably mounted to the tank cover 114 by a push-push open/close button 139. Thus, the filter cover 116 can pivot from the closed position shown in FIGS. 2 and 3 to the open position shown in FIG. 4 so as to provide access to the filter cartridge 52 when the cartridge needs replacing. The tank cover 114 and filter cover 116 define a substantially flush or flat surface.

The light cover 118 is snap fit at the rear edge to the tank cover 114 via tabs 140, shown in FIG. 6. The front edge of the light cover 118 is supported by the façade, as described below. The tabs 140 can be depressed with a person's finger to detach the rear of the light cover 118 from the tank cover 114. The light cover 118 can then be pivoted down for removal, to provide access to the light fixture 92 when a bulb needs replacing. The light cover 118 includes a plurality of vent holes 133 to dissipate heat from the light fixture 92.

Thus, the false ceiling 112 constitutes a drop ceiling defining a space between the top wall 22 of the liner 20 and the ceiling 112 for housing the water and light systems for the refrigerator 10. The space or gap between the ceiling 112 and the top wall 22 is covered by a façade 148 extending across the width of the fresh food compartment 16. The façade 148 includes an opening 150 through which ice is delivered from the ice compartment 30 to the ice storage compartment 32 in the door 12. A door or flap 152 is pivotally mounted to the façade 148 so as to move between open and closed positions relative to the opening 150, when the door 12 is opened and closed, respectively. The movement of the flap 152 is controlled by a lever 154 extending through the façade 148. The lever 154 is engaged by the door 12 when the door is closed, so as to open the flap 152, and disengaged from the door 12 when the door is open, so as to close the flap 152.

Figure 15:
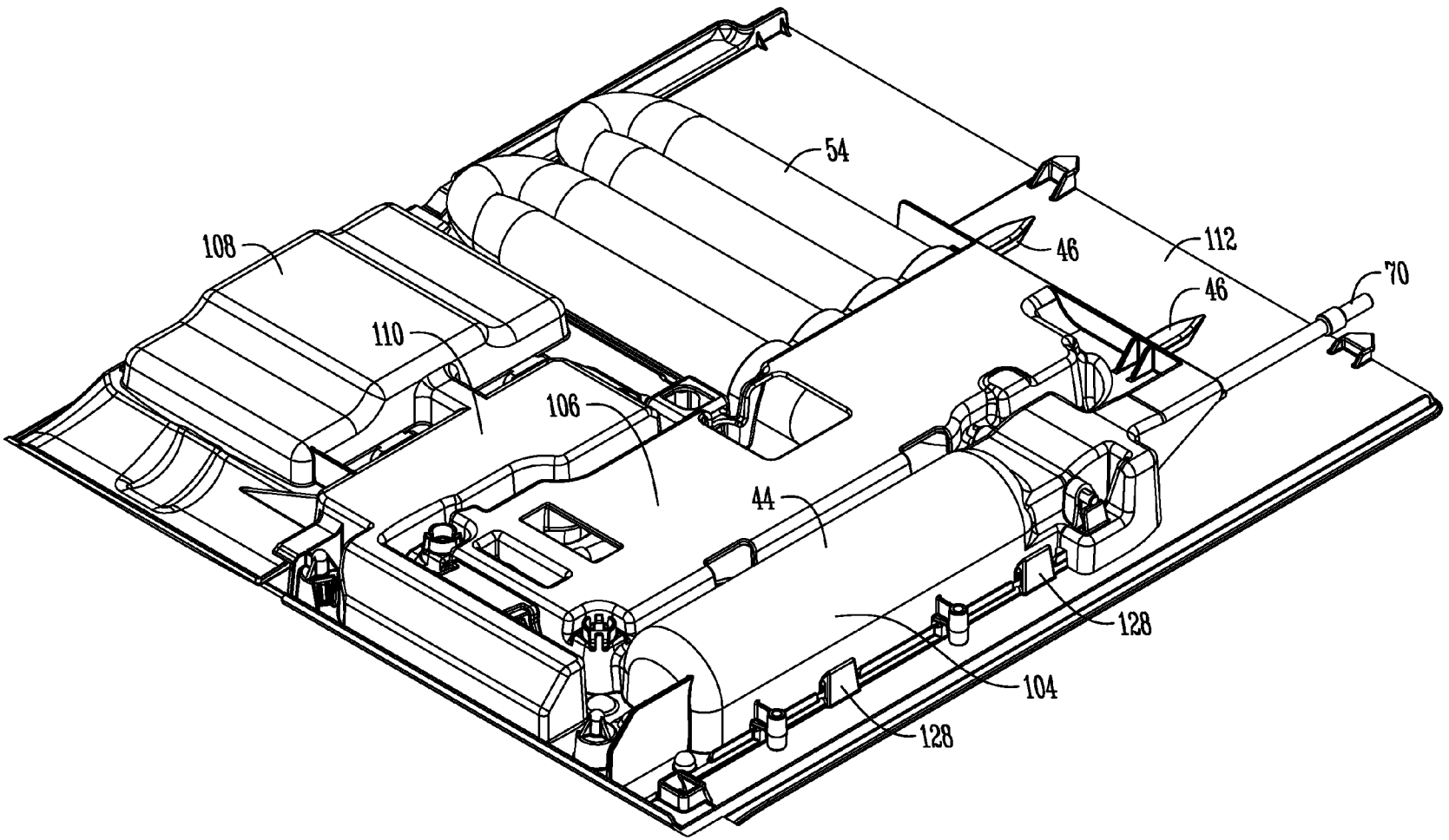
FIG. 15 is an upper perspective view of the mounting bracket and false ceiling.
Figure 16:
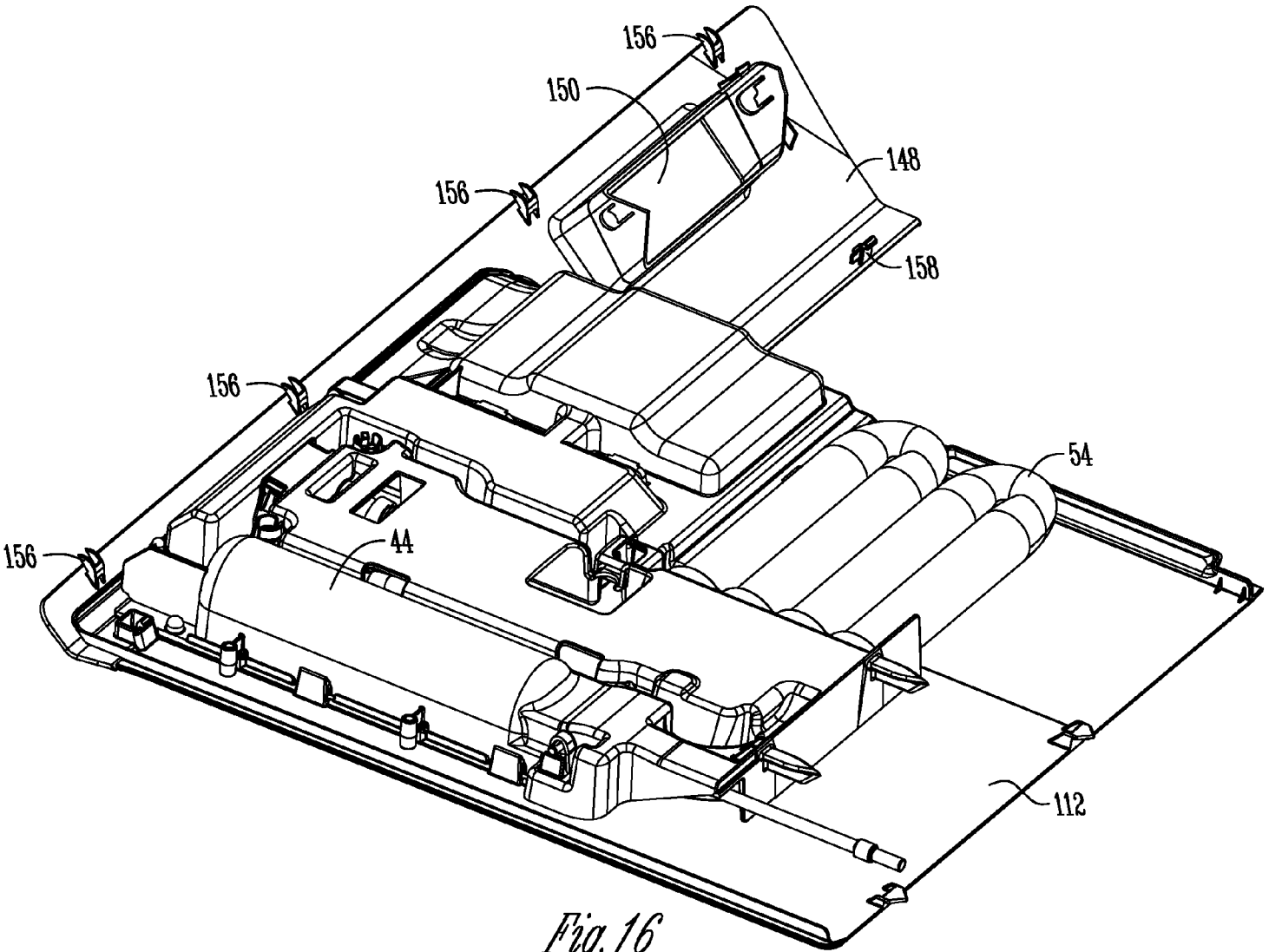
FIG. 16 is a further upper perspective view of the mounting bracket, false ceiling, and façade.
Figure 17:
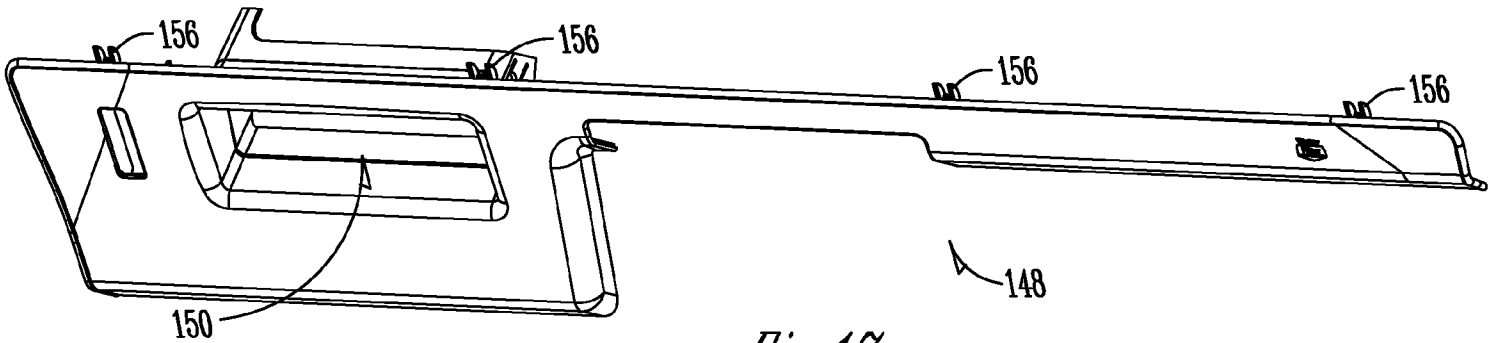
FIG. 17 is a perspective view of the façade.
Figure 18:
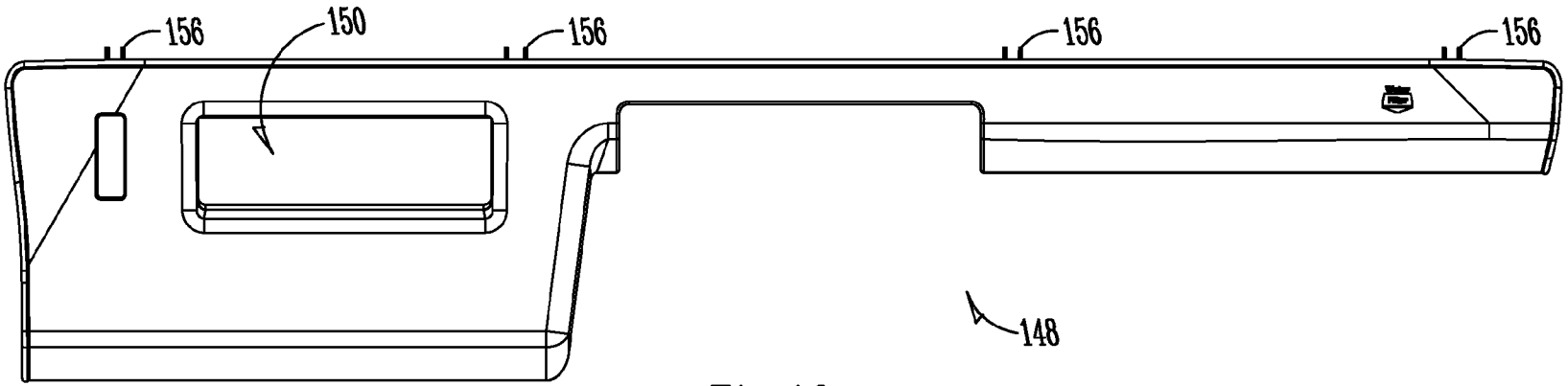
FIG. 18 is a front plan view of the façade.
Figure 19:
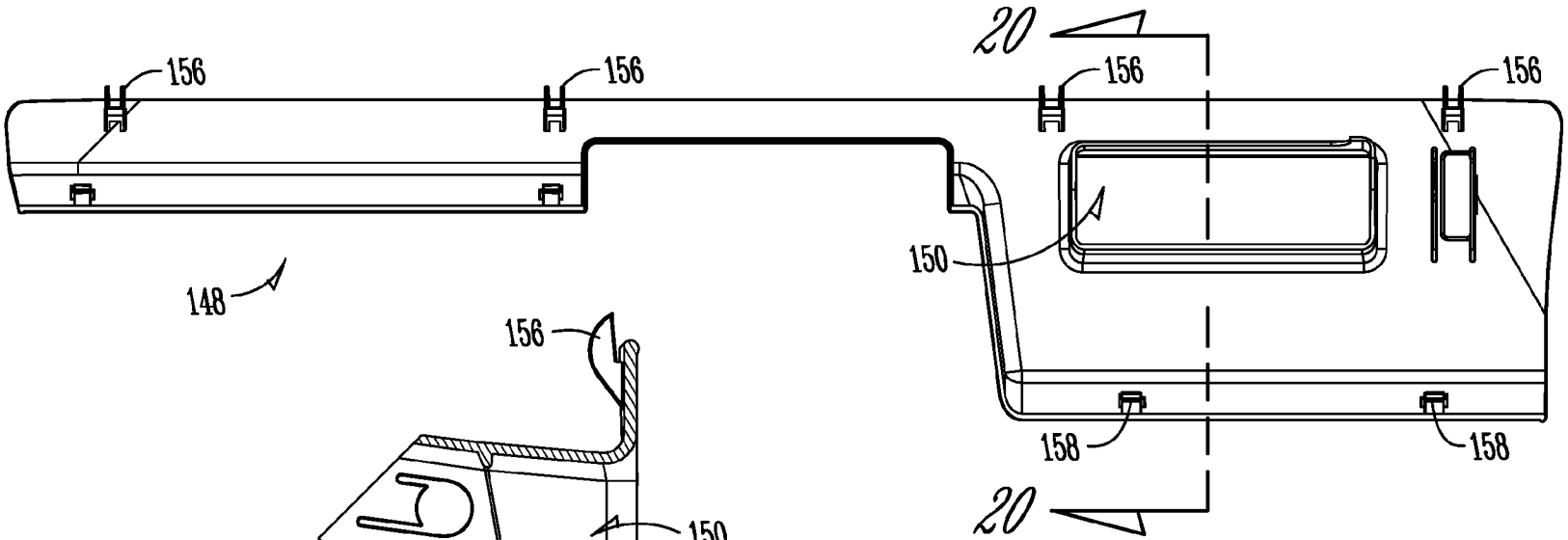
FIG. 19 is a back plan view of the façade.
Figure 20:
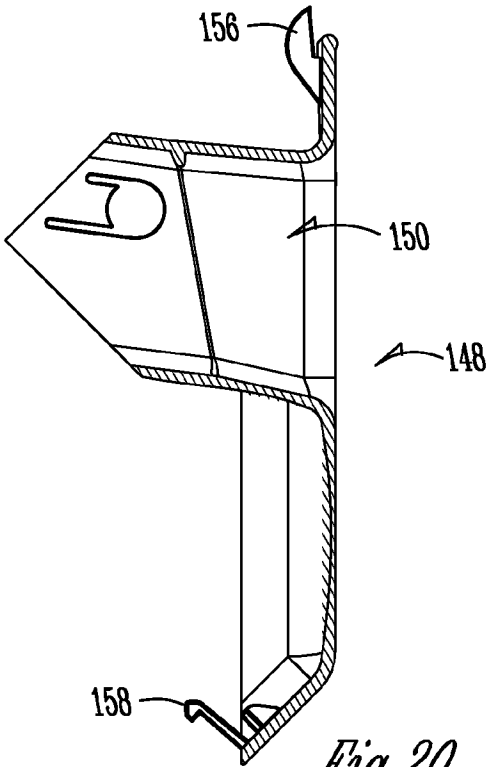
FIG. 20 is a sectional view of the façade taken along lines 20-20 of FIG. 19.

The façade 148 is mounted to the liner 20 and to the false ceiling 112 by a plurality of tabs 156, 158, respectively, as best seen in FIG. 20. The tabs 156 are first inserted into aligned openings in the top wall 22 of the liner 20, and then façade 148 is pivoted downwardly and rearwardly so that the lower tabs 158 snap fit through slots 160 in the filter cover 116, as seen in FIGS. 15 and 17. The façade 148 has a clear or translucent lens 162 aligned with the light fixture 92 to provide additional lighting for the fresh food compartment 16. The lens 162 supports the front edge of the light cover 118.

It is understood that the various mounting connections for the bracket 44, the water and light systems, the false ceiling 112, and the façade 148 may be modified from those shown in the drawings and described above, without departing from the scope of the invention. The mounting connections also may be moved to other locations to facilitate manufacturing and assembly.

In another aspect of the present invention, an improved assembly method is provided. The water filter assembly 50, 52, the water tank 54, the valve 56, the thermostat 58 and the lighting fixture 92 are pre-assembled on the bracket 44. Then the bracket 44 with the water and lighting systems is secured to the liner 20. The plumbing and electrical connections are then completed for the refrigerator 10. Next, the false ceiling, without the light cover 118, is installed. Then, the façade is attached. Lastly, the light cover 118 is installed by inserting the front edge above the lens 162 and then snapping the back edge into the tank cover 114. Thus, the ceiling 112 and façade 148 provides a clean, smooth aesthetic appearance for the fresh food compartment 16.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A refrigerator comprising:

a liner having a top wall, opposing side walls, a back wall, and a bottom wall, the liner defining a refrigerated compartment;

a bracket mounted to the liner adjacent the top wall, and having upper and lower faces;

a water system and light source secured to the bracket adjacent the lower face;

a false ceiling spaced apart from the top wall of the liner in covering relation to the water system, light source and bracket; and an ice making compartment adjacent the top wall of the liner, and the ceiling extending between one of the side walls and the ice making compartment.

2. The refrigerator of claim 1 further comprising an ice maker and a water dispenser, and the water system includes a water tank and a water filter, whereby the filter supplies water to the tank, and the tank supplies water to the ice maker and to the water dispenser.

3. The refrigerator of claim 2 wherein the filter includes a manifold pivotally mounted to the bracket and a cartridge removably mounted on the manifold.

4. The refrigerator of claim 2 wherein the water system further includes a valve secured to the bracket to control flow of water from the tank.

5. The refrigerator of claim 1 wherein the water system is pre-assembled to the bracket outside of the refrigerator, before the bracket is mounted to the liner.

6. The refrigerator of claim 1 wherein the ceiling includes a water filter cover moveable between open and closed positions, a water tank cover and a removable light cover.

7. The refrigerator of claim 6 wherein the filter cover has a first end pivotally mounted to the tank cover.

8. The refrigerator of claim 7 wherein the filter cover has a second end releasably attached to the tank cover by a push-push button.

9. The refrigerator of claim 2 wherein the water tank is oriented substantially horizontally.

10. The refrigerator of claim 9 wherein the water tank has an upper wall, a water inlet, and a water outlet adjacent the upper wall to minimize air in the tank.

11. The refrigerator of claim 1 wherein the light source includes a wiring harness secured in the bracket and connected to the light source.

12. The refrigerator of claim 1 wherein the false ceiling includes drain holes to drain water in the event of a leak in the water system without exposure to the light source.

13. The refrigerator of claim 1 wherein the false ceiling includes a dam to prevent water from accessing the light source in the event of a leak in the water system.

14. The refrigerator of claim 1 wherein the liner includes a recess in the top wall for receiving the bracket.

15. A refrigerator comprising:

a liner having a top wall, opposing side walls, a back wall, and a bottom wall, the liner defining a refrigerated compartment;

a bracket mounted to the liner adjacent the top wall, and having upper and lower faces;

a water system and light source secured to the bracket adjacent the lower face;

a false ceiling spaced apart from the top wall of the liner in covering relation to the water system, light source and bracket; and an ice maker and a water dispenser, and the water system includes a water tank and a water filter wherein the filter includes a manifold pivotally mounted to the bracket and a cartridge removably mounted on the manifold, whereby the filter supplies water to the tank, and the tank supplies water to the ice maker and to the water dispenser.

16. The refrigerator of claim 15 wherein the water system further includes a valve secured to the bracket to control flow of water from the tank.

17. A refrigerator, comprising:

a liner having a top wall, opposing side walls, a back wall, and a bottom wall, the liner defining a refrigerated compartment;

a bracket mounted to the liner adjacent the top wall, and having upper and lower faces;

a water system and light source secured to the bracket adjacent the lower face; and a false ceiling spaced apart from the top wall of the liner in covering relation to the water system, light source and bracket wherein the ceiling includes a water tank cover, a removable light cover, and a water filter cover moveable between open and closed positions and wherein the filter cover has a first end pivotally mounted to the tank cover.

18. The refrigerator of claim 17 wherein the filter cover has a second end releasably attached to the tank cover by a push-push button.

19. A refrigerator comprising:

a liner having a top wall, opposing side walls, a back wall, and a bottom wall, the liner defining a refrigerated compartment;

a bracket mounted to the liner adjacent the top wall, and having upper and lower faces;

a water system and light source secured to the bracket adjacent the lower face, wherein the light source includes a wiring harness secured in the bracket and connected to the light source; and a false ceiling spaced apart from the top wall of the liner in covering relation to the water system, light source and bracket.

20. A refrigerator comprising:

a liner having a top wall, opposing side walls, a back wall, and a bottom wall, the liner defining a refrigerated compartment;

a bracket mounted to the liner adjacent the top wall, and having upper and lower faces;

a water system and light source secured to the bracket adjacent the lower face; and a false ceiling spaced apart from the top wall of the liner in covering relation to the water system, light source and bracket and wherein the false ceiling includes a dam to prevent water from accessing the light source in the event of a leak in the water system.

* * * * *

UNITED STATES PATENT AND TRADEMARK OFFICE

CERTIFICATE OF CORRECTION

PATENT NO. : 8,020,403 B2
APPLICATION NO. : 12/277902
DATED : September 20, 2011
INVENTOR(S) : Chad J. Rotter et al.

It is certified that error appears in the above-identified patent and that said Letters Patent is hereby corrected as shown below:

Column 6, Line 56
DELETE: "A refrigerator, comprising"
ADD: --A refrigerator comprising--

Signed and Sealed this
Thirteenth Day of December, 2011

David J. Kappos

David J. Kappos
*Director of the United States Patent and Trademark Office*